US005140301A

United States Patent [19]

Watanabe

[11] Patent Number: 5,140,301

[45] Date of Patent: Aug. 18, 1992

[54] GUIDANCE METHOD AND APPARATUS IN CASE OF EMERGENCY EVACUATION

[75] Inventor: Yasuo Watanabe, Tokyo, Japan

[73] Assignee: Kabushiki Kaisha Seidenko, Tokyo, Japan

[21] Appl. No.: 415,313

[22] PCT Filed: Jan. 20, 1989

[86] PCT No.: PCT/JP89/00049

§ 371 Date: Sep. 19, 1989

§ 102(e) Date: Sep. 19, 1989

[87] PCT Pub. No.: WO89/06556

PCT Pub. Date: Jul. 27, 1989

[30] Foreign Application Priority Data

Jan. 22, 1988 [JP] Japan ..... 63-11994

[51] Int. Cl.[5] ..... G08B 5/00

[52] U.S. Cl. ..... 340/332; 340/628; 362/147; 40/560

[58] Field of Search ..... 340/331, 332, 628; 362/147, 148, 20, 812; 350/6.6; 353/98, 99; 40/559, 560, 561, 562; 116/202

[56] References Cited

U.S. PATENT DOCUMENTS 4,084,339 4/1978 Peltier et al. ..... 40/560
4,649,376 3/1987 Frank ..... 340/691
4,802,065 1/1989 Minter et al. ..... 362/20

FOREIGN PATENT DOCUMENTS 4510032 5/1970 Japan .
53-142897 12/1978 Japan .

*Primary Examiner*—Forester W. Isen
*Assistant Examiner*—Jeffery A. Hofsass
*Attorney, Agent, or Firm*—Ladas & Parry

[57] ABSTRACT

A guidance apparatus in case of emergency evacuation comprising a laser which is disposed within a building or the like in such way that a laser beam emitted from the laser is directed in the direction in which evacuees must escape or is directed from the side of an emergency exit toward the interior of the building or the like; abnormal condition detection means for detecting the occurrence of an abnormal condition in the building or the like and generating a detection signal representative of the occurrence of an abnormal condition; and a control unit which is connected to the laser and the abnormal condition detection means and which, in response to the detection signal, energizes the laser. When an abnormal condition such as fire occurs within the building or the like, the detection means detects the occurrence of an abnormal condition and generates a detection signal, in response to which the laser in energized to emit a laser beam directing the direction in which evacuees must escape.

11 Claims, 4 Drawing Sheets

GUIDANCE METHOD AND APPARATUS IN CASE OF EMERGENCY EVACUATION

TECHNICAL FIELD

The present invention relates to a guidance method and apparatus for emergency evacuation of people out of a building or the like when abnormal conditions or accident occurs.

BACKGROUND OF THE INVENTION

When a fire or other accident occurs in a building or an underground building, people in that building must be evacuated. To this end an alarm signal generating system, an emergency lighting system, a system for displaying and indicating emergency exits and the like are installed, but at present, previously trained men and women use loudspeakers, flashlights and the like in order to guide and evacuate people inside the building.

However, the above-described guidance method in the case of emergency evacuation by shouting in loud voices or turning on lighting equipment is almost ineffective when people are seized with panic and if the guidance of people to a safety place by the guides is not carried out satisfactory and properly, the guidance method using guides is also ineffective. Furthermore in the case of emergency lighting utilizing light sources, when smoke is produced, light rays prevent transmission through smoke so that the words indicating the emergency exits become almost impossible to read. Furthermore when an emergency passage turns in a complex way vision blocked by obstacles, it becomes impossible for people to select a suitable emergency passage.

The present invention was made to overcome the above and other problems encountered in the conventional guidance methods and apparatus in the case of emergency evacuation and has for its object to provide a guidance method and apparatus in the case of emergency evacuation when a fire or the like happens, which can provide evacuation information to the evacuees and correctly guide them to a safe place.

SUMMARY OF THE INVENTION

To the above and other ends, a guidance method in case of emergency evacuation in accordance with the present invention is characterized in that abnormal conditions occurring in a building or the like are detected and converted into the abnormal detection signal representative of the occurrence of abnormal conditions; in response to the detection signal, a laser is automatically energized to emit a laser beam which is directed in the direction in which the evacuees are to escape.

An emergency guidance system of the present invention is characterized in that the generated laser beam is redirected toward the direction in which the evacuees must escape by utilizing one or more optical scanners installed in the building or the like.

Furthermore, a guidance method in case of emergency evacuation of the present invention is characterized in that abnormal conditions occurring in a building or the like are detected and converted into a detection signal representative of the occurrence of abnormal conditions and in response to the detection signal, a laser is automatically energized to emit a laser beam from the side of an emergency exit towards the interior of the building or the like.

Moreover, a guidance method in the case of emergency evacuation is characterized in that a laser beam is directed from an emergency exit toward the interior of a building or the like by utilizing one or more optical scanners.

An emergency evacuation guidance apparatus of the present invention is characterized by comprising a laser so disposed as to emit a laser beam within a building or the like in the direction in which the evacuees must escape; abnormal condition detection means for detecting abnormal conditions which occur in the building or the like and for generating an abnormal condition detection signal representative of the occurrence of any abnormal condition and a control unit connected to both the laser and the abnormal condition detection means and adapted to energize the laser in response to the abnormal condition detection signal.

Furthermore, a guidance apparatus in case of emergency evacuation of the present invention is characterized by comprising a laser so disposed within a building or the like as to emit a laser beam to the direction in which evacuees must escape; one or more optical scanners for scanning the laser beam emitted from the laser; abnormal condition detection means for detecting abnormal conditions within the building or the like and for generating a detection signal representative of the occurrence of an abnormal condition; and a control unit connected to the laser, the optical scanners and the abnormal condition detection means and adapted to energize the laser and activate the optical scanners in response to the detection signal.

Moreover, a guidance apparatus in case of emergency evacuation in accordance with the present invention is characterized by comprising a laser so disposed within a building or the like as to emit a laser beam from the side of an emergency evacuation toward the interior of the building or the like, abnormal condition detection means for detecting the occurrence of abnormal conditions with the building or the like and for generating a detection signal representative of the occurrence of an abnormal condition, and a control unit connected to the laser and the abnormal condition detection means and adapted to energize the laser in response to the detection signal from the detection means.

A guidance apparatus in case of emergency evacuation of the present invention is characterized by comprising a laser disposed in such a way that a laser beam emitted from the laser is directed from the side of an emergency exit towards the interior of a building or the like, one or more optical scanners installed in the building or the like for scanning the laser beam emitted from the laser and a control unit connected to the laser, the optical scanners and the abnormal condition detection means and a control unit and to energize the laser and one or more optical scanners in response to the detection signal from the detection means.

DETAILED DESCRIPTION OF THE PREFERRED EMBODIMENTS

Now the present invention will be described with reference to the accompanying drawings.

Figure 1:
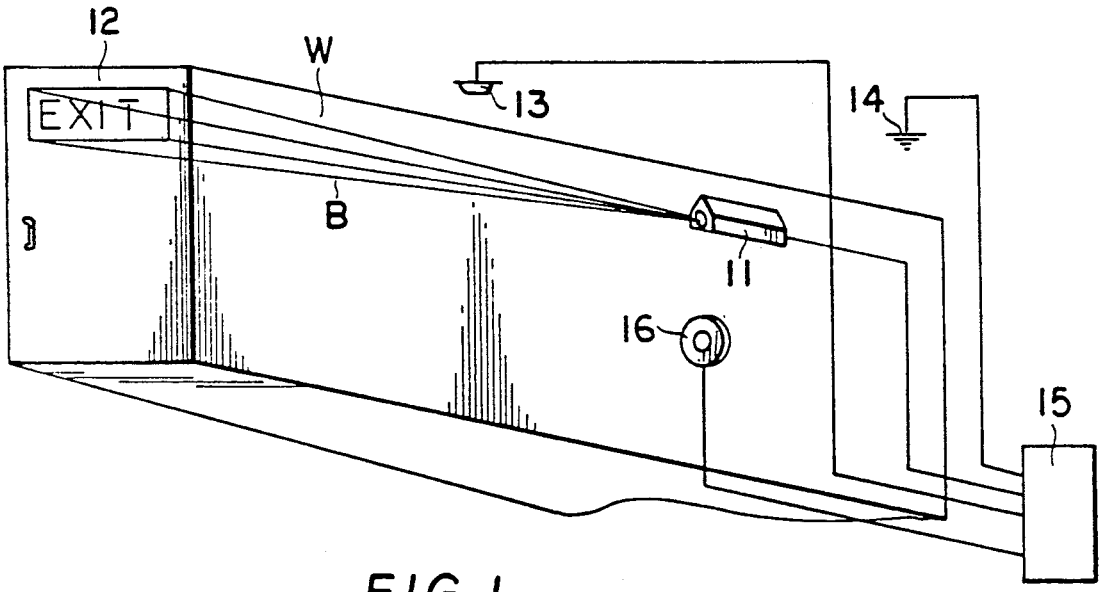
FIG. 1 schematic perspective view illustrating a first pre embodiment of a guidance apparatus for emergency evacuation.

FIG. 1 is a schematic perspective view illustrating the fundamental construction of a guidance apparatus in the case of emergency evacuation in accordance with the present invention. In FIG. 1 reference numeral 11 represents a laser for emitting a laser beam. The laser 11 is so arranged that the laser beam is emitted to a direction in which the evacuees must escape, that is, to an emergency exit 12. It is preferable that the laser 11 is disposed at a relatively high position, for instance, at a position in the vicinity of the upper side edge portion of a wall so that the evacuees can easily see the laser 11.

A power supply is incorporated within the laser 11 so that even when the supply of electric power to a building or the like is cut off, the laser 11 may be energized.

Reference numerals 13 and 14 represent abnormal condition detectors which generate the abnormal condition signals in response to abnormal conditions or the like in the building. For instance, the detector 13 is a smoke sensor attached to the ceiling and the detector 14 is an earthquake sensor attached to a wall surface or a floor. In addition, a temperature sensor, a gas sensor or the like may be combined and used.

These abnormal condition sensors 13 and 14 are connected to a control unit 15 so that the signals representative of abnormal conditions may be transmitted from the sensor 13 and 14 to the control unit 15. The laser 11 is also connected to the control unit 15 so that an activation command signal is transmitted to the laser 11 in response to the signals representative of abnormal conditions (to be referred as "the direction signals" hereinafter in this specification).

The control unit 15 is further connected to a conventional push-button type alarm device 16 so that the abnormal condition signal is transmitted manually.

Next the mode of operation of the first embodiment with the construction described above will be described.

In the case of an abnormal condition such as a fire in a building or the like, such abnormal condition is detected by sensors 13 and 14 and the detected signals are transmitted to the control unit 15. In response to these signal received, the control unit 15 transmits the activation command signal to the laser 11 so that the latter is automatically energized and emits a laser beam B in the direction of the emergency evacuation.

The evacuees see the direction of the laser beam B and recognize the emergency evacuation passage. In order that the evacuees have the clearer perception of the evacuation passage, it is effective, for instance, to diverge the width of the emitted laser beam B. It is more effective when the emergency announcement that "Please evacuate along the laser beam" is made.

The laser beam B has the property that it travels straight without any damping of its energy even when the smoke is produced, so the laser beam B can travel a long distance and consequently there is not fear that the evacuees miss the evacuation passage. The trace of the laser beam B is reflected by the particles in smoke so that the evacuation passage can be more clearly indicated.

As described above, according to the first embodiment, even in the building or the like filled with smoke, the evacuees can be safely guided to the emergency exit.

In the first embodiment, the control unit 15 is disposed independently, but it is to be understood that it may be integrally incorporated into the laser 11.

Figure 2:
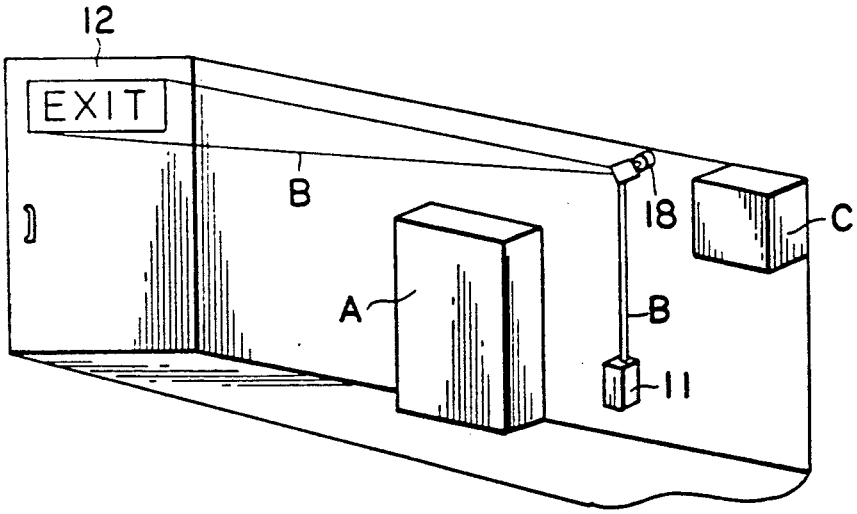
FIG. 2 is a schematic perspective view illustrating a second preferred embodiment of the present invention when an obstruction exists in the path of the laser beam.

FIG. 2 is a schematic view illustrating a second embodiment of the present invention when an obstacle exists in an evacuation passage.

For instance, when an obstacle A exists in the evacuation passage and a projection C is extended from the wall at which the laser 11 is preferably disposed so that the laser 11 cannot emit the laser beam B directly to the emergency exit 12, the optical path of the laser beam B is changed in direction by an optical scanner 18 so that it becomes possible to emit the laser beam B to a desired place.

The optical scanner 18 comprises a mirror which is repeatedly rotated and a motor for driving the mirror. When the laser beam B reaches the optical scanner 18, it is reflected in a desired direction. It is preferable that a power supply (a battery) be incorporated in the optical scanner 18 as a provision against the failure of power supply.

The optical scanner 18 is disposed at a suitable position on the optical path of the laser beam B emitted from the laser 11 and the angle of rotation of the mirror of the optical scanner 18 is controlled so that the reflected laser beam B is directed toward the emergency exit 12. The optical scanner 18 is electrically connected to a control unit (not shown) as is in the case of the abnormal condition sensors and the laser described above in the first embodiment.

According to the second embodiment, therefore, when the detection signals are transmitted from the abnormal condition sensors, the laser 11 is energized to emit the laser beam B simultaneously with the activation of the optical scanner 18. By the mirror of the optical scanner 18, the width of the laser .beam B is enlarged to a predetermined value and the laser beam B is directed to a desired place (for instance, the emergency exit 12).

As a result, the optical path of the laser beam B can be varied so that even when an obstruction A exists in the optical path, the laser beam B for guidance in the case of the emergency evacuation can be clearly recognized and can travel to a predetermined place.

As means for changing the optical path of the laser beam B, a conventional mirror which is securely maintained in the stationary state may be used instead of the optical scanner 18. However, it must be noted here that when the optical scanner 18 is utilized, the small width between one to eight mm of the laser beam B can be enlarged to a width so that the evacuees may easily recognize it. The surface of the optical mirror 18 is machined with a high degree of accuracy so that the scattering of light is reduced. Furthermore, it has an effect that even when the surface of the optical scanner 18 is more or less contaminated, the reflectivity of the laser beam B is not decreased.

Figure 3:
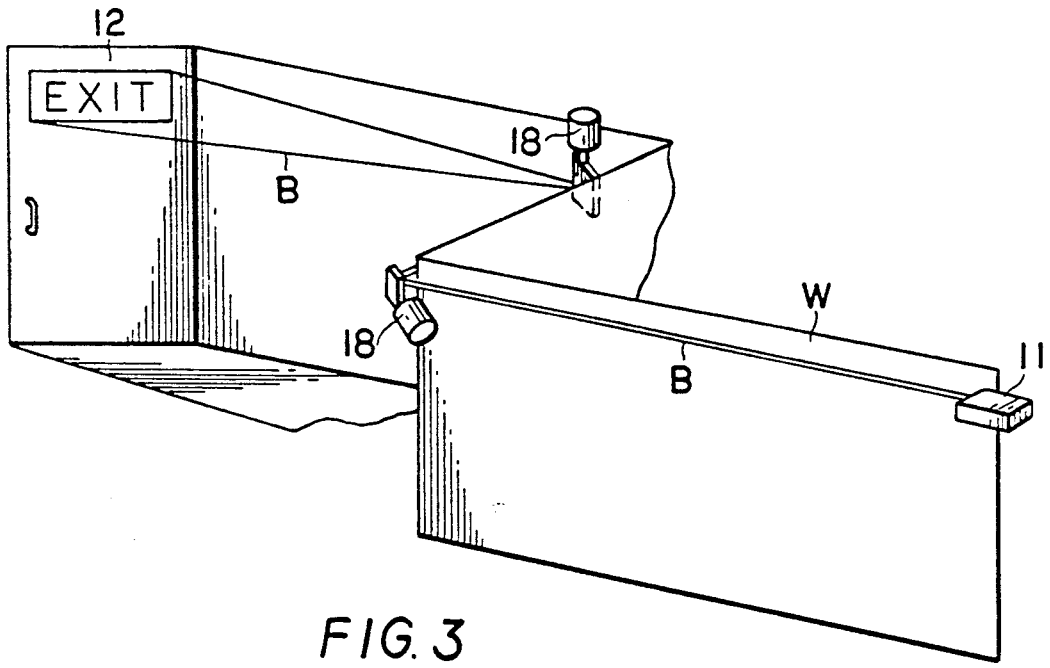
FIG. 3 is a schematic perspective view of a third preferred embodiment when an escaping or evacuation passage is not straight.

FIG. 3 is a schematic perspective view illustrating a third preferred embodiment of the present invention which may be applied to an evacuation passage (for instance, a corridor) which is bent.

The laser beam is so located at a position that the laser beam emitted travels along the evacuation passage. At the bent portion of the evacuation passage at which the wall W is bent and the corner of the bent wall W, the optical scanners 18 each comprising a rotary mirror and a small-sized motor are disposed, respectively, so that the laser beam is directed in the direction of evacuation. As is the second embodiment, the laser 11, the abnormal condition sensors and the optical scanners 18 are electrically connected to a control unit (not shown).

According to the third embodiment, the laser beam B emitted from the laser 11 has its optical path changed at each bent portion of the evacuation passage and reaches the emergency exit 12. Thus, when the evacuees escape along the optical path of the laser beam B, they can correctly reach the emergency exit 12. In the third embodiment, stationary mirrors may be used instead of the optical scanners 18.

Figure 4:
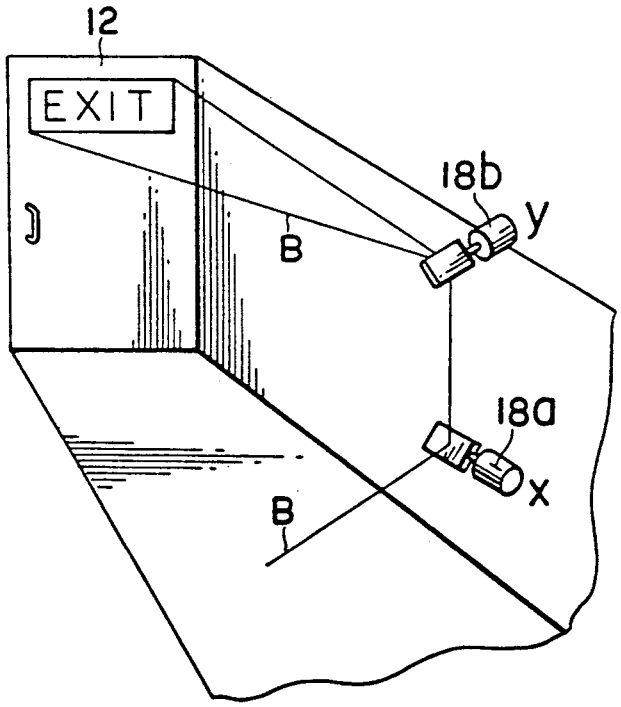
FIGS. 4 and 5 are schematic perspective views illustrating a fourth and a fifth embodiment of the present invention in which two optical scanner are utilized so that the laser beam can be used for various purposes.

FIG. 4 is a schematic perspective view illustrating a fourth preferred embodiment of the present invention which is used for instance, to brilliantly and distinctly illuminate the emergency exit in green color as is required in accordance with the Fire Prevention Law.

In the fourth embodiment, an X-axis optical scanner 18*a* and a Y-axis optical scanner 18*b* are disposed at suitable positions on the optical path of the laser beam B in such a way that the axes of the optical scanners 18*a* and 18*b* are mutually perpendicular. Due to the oscillation of the mirrors, the laser beam B is directed in the X-axis direction and in the Y-axis direction so that the width of the laser beam B can be enlarged.

Therefore, it becomes possible to illuminate a predetermined area so that character information representing "Emergency Exit" may be clearly and distinctly recognized. The fourth embodiment is especially advantageous in that even the surrounding place is filled with smoke it becomes easy to recognize the emergency exit.

Figure 5:
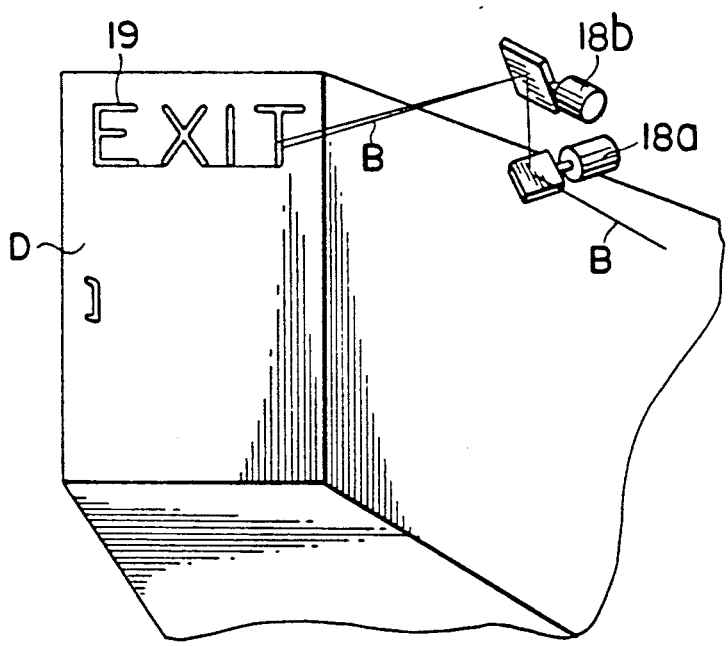

FIG. 5 is a schematic perspective view illustrating a fifth embodiment of the present invention which is a modification of the fourth embodiment equipped with the X-axis optical scanner 18*a* and the Y-axis optical scanner In the fifth embodiment, the number of rotary oscillations of the X- and Y-axis optical scanners 18*a* and 18*b* is controlled so that the information "EMERGENCY EXIT" 19 is displaced on an inner side surface of an emergency escape door D.

Furthermore, it becomes possible to display any letter by controlling the numbers of rotary oscillations of the optical scanners 18*a* and 18*b*. Furthermore, in addition to the emergency door, the fifth embodiment can display any desired character or pattern information on the wall surface, concentrated smoke and the space.

As described above, the character information is displayed so that the evacuees have a sense of security.

Figure 6:
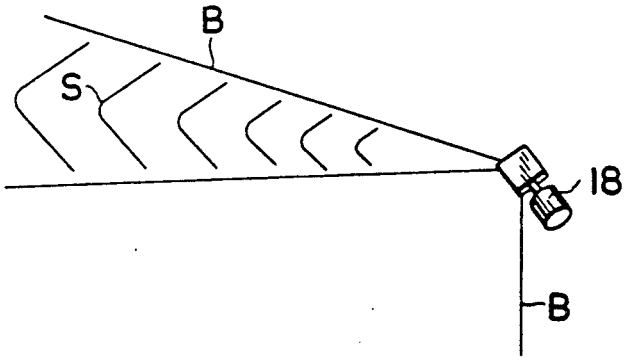
FIG. 6 is a view used to explain a sixth embodiment of the present invention in which the laser beam is shaped in the form of waves.

FIG. 6 is a view to explain a sixth embodiment of the present invention. According to the sixth embodiment, the frequency of the optical scanner 18 is controlled so that the width W of the laser beam B is diverged in the direction of evacuation. Furthermore, as shown in FIG. 6, within a band defined by the laser beam B is displayed a wave shape S such as a plurality of bent lines which are spaced apart from each other by a predetermined distance in the evacuation direction.

As described above, when such waveform S is displaced, the evacuees can correctly recognize the direction of evacuation.

Figure 7:
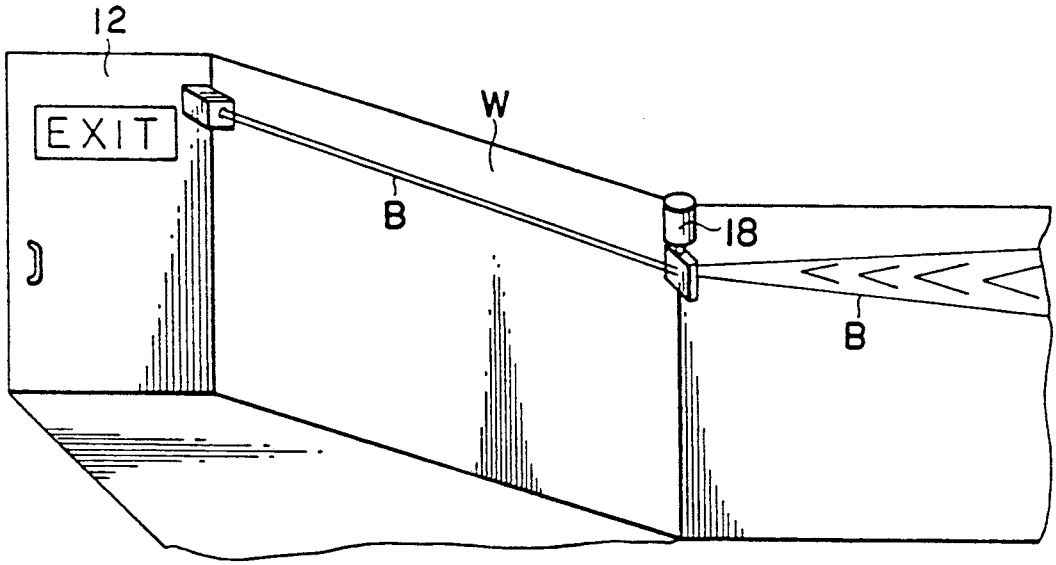
FIG. 7 is a schematic perspective view illustrating a seventh embodiment of the present invention.

FIG. 7 illustrates a seventh preferred embodiment of the present invention. According to the seventh embodiment, the laser 11 is disposed in the vicinity of the emergency exit 12 so that the laser beam B is emitted to the interior space of a building or the like. At each bend of the evacuation passage is installed an optical scanner 18 so that the laser beam B emitted from the laser 11 reaches the innermost position of the interior space of the building or the like.

According to the seventh embodiment, the laser beam B is emitted from the laser 11 disposed in the vicinity of the emergency exit 12 so that even when the interior of the building or the like is filled with thick smoke, it is possible to display the direction toward the emergency exit 12. Even when the laser beam B does not reach a desired place because of loss of energy of the laser beam B, the evacuees can recognize the direction toward the emergency exit 12 which is one of the most important means of evacuation in an emergency.

Furthermore, the laser beam B is converged in width toward the emergency exit 12 so that the evacuees obtain a feeling of security.

Figure 8:
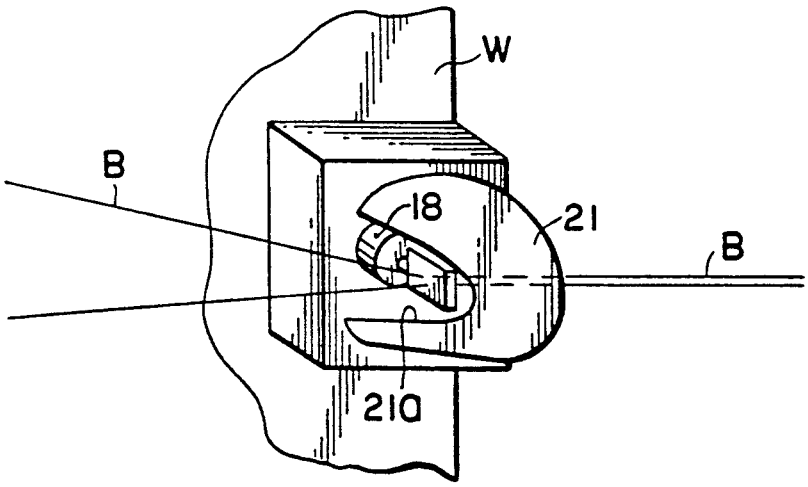
FIG. 8 is a schematic view illustrating the outer appearance of a protective cover for an optical scanner.

FIG. 8 is a schematic view illustrating the outer appearance of a protective cover 21 of the optical scanner 18. The optical scanners installed within a building or the like tend to be broken when they collide with other things. The protective cover has a cut-away portion 21*a* only in the optical path of the laser beam B.

INDUSTRIAL APPLICABILITY

As described above, a laser beam with a high degree of transmission efficiency is emitted in the direction which indicates the emergency exit from the interior of a building or the like or is emitted from the interior to the emergency exit so that the emergency evacuation guidance information can be distinctly displayed without being adversely affected by smoke. Furthermore, the optical scanners are used in combination with a laser so that the latter can be applied for various purposes such as changing the optical path of the laser, enabling multi purpose use of the laser beam, and expanding the range of application of the emergency evacuation guidance apparatus.

When the apparatuses in accordance with the present invention are installed in the department stores, hotels, offices, underground markets and the like, they become very auxiliary means in case of emergency.

I claim:

1. A guidance method in case of emergency evacuation comprising the steps of, detecting abnormal conditions in an enclosure and generating a detection signal representative of the occurrence of an abnormal condition;

automatically energizing a laser projecting means in response to said detection signal so as to emit a laser beam; and changing an optical path of the laser beam to the direction in which evacuees must escape in case of emergency evacuation by using means for changing the optical path.

2. A guidance method in case of emergency evacuation as set forth in claim 1, wherein the optical path of the laser beam is changed at a change in direction of a passage in the enclosure.

3. A guidance method as set forth in claim 1, wherein the optical path of the laser beam is changed by using one or more optical scanners which are installed within the enclosure.

4. A guidance method as set forth in claim 3, wherein the width of said laser beam is increased towards the direction of evacuation by using said optical scanners.

5. A guidance method as set forth in claim 3, wherein said laser beam displays a word indicating an emergency exit by using said optical scanners.

6. A guidance method as set forth in claim 1, wherein said laser beam is emitted from the side of the emergency exit to the interior of said enclosure.

7. A guidance apparatus in case of emergency evacuation comprising, a laser projecting means so disposed within an enclosure as to emit a laser beam which is directed in the direction in which evacuees must escape;

abnormal condition detection means for detecting the occurrence of an abnormal condition within said enclosure and generating a detection signal representative of the occurrence of an abnormal condition;

means for changing an optical path of said laser beam; and a control unit which is connected to said laser projecting means and said abnormal condition detection means and energizes said laser projecting means and said means for changing an optical path in response to said detection signal.

8. A guidance apparatus as set forth in claim 7, wherein the means for changing the optical path of the laser beam is disposed at a change in direction of a passage in the enclosure.

9. A guidance apparatus as set forth in claim 7, wherein the means for changing the optical path of the laser beam is an optical scanner for scanning the laser beam.

10. A guidance apparatus as set forth in claim 7, wherein said laser projecting means in disposed in the vicinity of an emergency exit.

11. A guidance apparatus as set forth in claim 9, wherein said laser beam comprises a plurality of bent lines indicating said direction of escape.

* * * * *